United States Patent [19]

Jarnuszkiewicz

[11] 4,131,090

[45] Dec. 26, 1978

[54] TWO-STROKE, MULTICYLINDER, SPARK IGNITION, PUMPLESS INJECTION INTERNAL COMBUSTION ENGINE

[76] Inventor: Stanislaw Jarnuszkiewicz, 29/8 Swierczewskiego Str., Krakow, Poland

[21] Appl. No.: 698,781

[22] Filed: Jun. 21, 1976

Related U.S. Application Data

[62] Division of Ser. No. 521,896, Nov. 7, 1974, Pat. No. 4,020,801.

[30] Foreign Application Priority Data

Nov. 9, 1973 [PL] Poland ..... 166446

[51] Int. Cl.[2] ..... F02B 13/10; F02B 19/00

[52] U.S. Cl. ..... 123/32 SP; 123/59 B; 123/59 BM; 123/65 E

[58] Field of Search ..... 123/59 EC, 65 E, 32 AE, 123/32 SP, 122 E, 59 B, 59 BM, 139 AJ, 33 B, 33 C, 33 E, 60, 73 AA

[56] References Cited

U.S. PATENT DOCUMENTS

| | | | |
|---|---|---|---|
| 910,220 | 1/1909 | Nichols | 123/32 SP |
| 1,312,387 | 8/1919 | Connolly | 123/59 EC |
| 1,314,561 | 9/1919 | Wright | 123/139 AJ |
| 1,354,786 | 10/1920 | Tartrais | 123/32 SP |
| 1,377,139 | 5/1921 | Murphy | 123/33 B |
| 2,061,826 | 11/1936 | Bremser | 123/32 SP |
| 2,440,645 | 4/1948 | Pyk et al. | 123/65 |
| 3,289,656 | 12/1966 | Strang | 123/59 B |
| 3,762,378 | 10/1973 | Bitonti | 123/122 E |

FOREIGN PATENT DOCUMENTS

| | | | |
|---|---|---|---|
| 372807 | 3/1921 | Fed. Rep. of Germany | 123/59 B |
| 1576009 | 5/1970 | Fed. Rep. of Germany | 123/122 E |

*Primary Examiner*—Charles J. Myhre
*Assistant Examiner*—Andrew M. Dolinar
*Attorney, Agent, or Firm*—Haseltine, Lake & Waters

[57] ABSTRACT

This invention relates to a two-stroke, spark ignition, internal combustion engine, with two, three, four or six cylinders. Fuel injection is provided by means of combustion gases and no fuel pump is employed. The working spaces of the engine cylinders are interconnected by means of ducts in such a manner that during the working stroke a small amount of high pressure combustion gases enters the working space. After the duct port is uncovered by the piston the combustion gases are carried over on their way by a predetermined amount of fuel, thereby effecting the injection.

4 Claims, 8 Drawing Figures

TWO-STROKE, MULTICYLINDER, SPARK IGNITION, PUMPLESS INJECTION INTERNAL COMBUSTION ENGINE

This is a division of application Ser. No. 521,896, filed Nov. 7, 1974, now U.S. Pat. No. 4,020,801.

BACKGROUND OF THE INVENTION

This invention relates to a two-stroke, spark ignition, internal combustion engine, with two, three, four or six cylinders. Fuel injection is provided by means of combustion gases and no fuel pump is employed. In this engine the working spaces of cylinders are interconnected by means of ducts in such a manner that during the working stroke a small amount of high pressure combustion gases enters the working space, after the duct port is uncovered by the piston, carrying along a predetermined amount of fuel, thereby effecting the injection.

The engine according to this invention operates as follows: fuel injection is accomplished, with the absence of any fuel pump, in a three-cylinder two-stroke engine in which the cranks are spaced 120 deg. apart. The working space of each cylinder is connected by two small bore ducts with the other cylinders and each of these ducts has the inlet in the cylinder wall of one cylinder above the piston midstroke and the injection outlet in the cylinder wall of the other cylinder below the midstroke. To accomplish pumpless fuel injection in a four-cylinder two-stroke internal combustion engine, the cylinders are arranged in series or in the form of a V, in such a manner that the working spaces of cylinders, in which ignition occurs every 180 deg. of crankshaft revolution, are interconnected by gas ducts to which the fuel is delivered at a controlled rate so that the exhaust gases of one cylinder carry the fuel and accomplish the injection in the other cylinder in which the ignition takes place after an additional crankshaft revolution of 180 degrees. The exhaust gases from this second cylinder inject the fuel in the first cylinder after an additional crankshaft revolution of 180 degrees.

This invention accomplishes pumpless injection of fuel in a six-cylinder, two-stroke engine with the cylinders arranged in series or in the form of a V in such a manner that the working spaces of cylinders are interconnected by gas ducts to which the fuel is delivered at a predetermined rate; each pair of cylinders in which ignition occurs every 180 deg. of crankshaft revolution is interconnected, or each three cylinders in which the ignition occurs every 120 deg. are interconnected by means of ducts. Each of the said ducts has the inlet in the cylinder wall of one cylinder above the piston midstroke and the injection outlet in the other cylinder below the piston midstroke.

A common characteristic trait of several embodiments of the invention is the fact that the axes of symmetry of injection ports are directed towards the inlets of precombustion chambers, and that the spark plug is located in the precombustion chamber within the conical surface or are defined by the injection stream, of the fuel introduced into the precombustion chamber gas passages; open fuel meters are provided which consist of a metering chamber with a capacity greater than the maximum charge of fuel needed for one working cycle and inlet and outlet ducts each with passages of a diameter less than ½ of the gas duct bore. At the place where fuel meter is located; a solenoid-operated fuel valve can be also installed. Apart from this, a further common characteristic trait is that the fuel supply ducts to the meters are preheated by means of combustion gases and that the gas duct inlet ports widen with an off-set in the proximity of the cylinder bearing surface.

The hitherto known solutions of two-cylinder internal combustion engines with pump-less injection of fuel, in which the working spaces are interconnected by gas ducts, do not provide for any system of three-and more cylinder engines and do not specify the direction of the injection stream, location of spark plug and fuel meters.

SUMMARY OF THE INVENTION

In the internal combustion engine according to this invention a pump-less injection of fuel into three-four- and six-cylinder engines and open fuel meters has been employed, thereby eliminating automatic valves that are unreliable in operation. The injection of fuel into the interior of precombustion chamber within the vicinity of the spark plug has been employed with simultaneous preheating of the fuel duct with combustion gases, using widened inlet ports on the gas ducts in the vicinity of the cylinder bearing surface in order to eliminate the collection of carbon deposits at the port outlets.

The above described improvements permit the use of economical and simple injection systems in all two-stroke, multi-cylinder, internal combustion engines, with very low consumption of fuel, possibility of using heavy fuels and decrease in the toxicity of combustion gases being obtained.

BRIEF DESCRIPTION OF THE DRAWINGS

The internal combustion engine according to this invention is illustrated by drawings.

DESCRIPTION OF THE PREFERRED EMBODIMENTS

Figure 1:
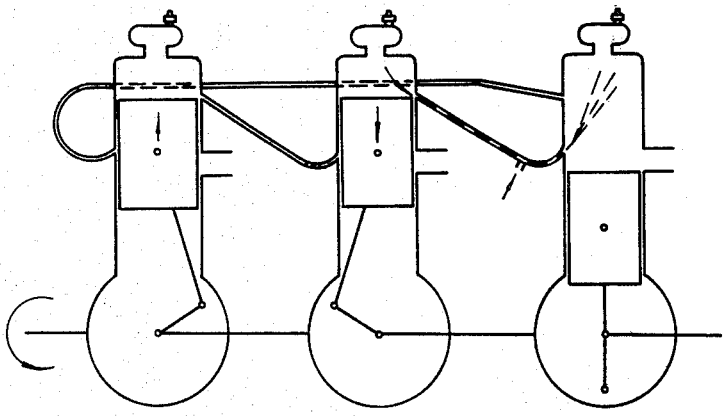
FIG. 1, FIG. 2 and FIG. 3 represent diagrammatically a three-cylinder engine, and show fuel injection into individual cylinders.
Figure 2:
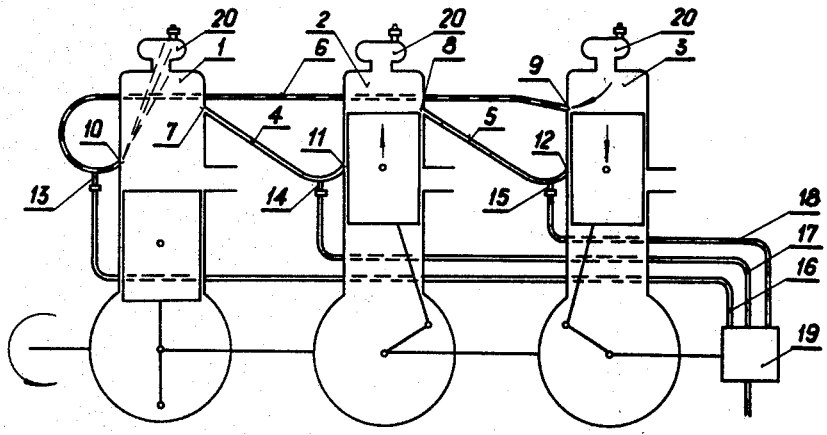
Figure 3:
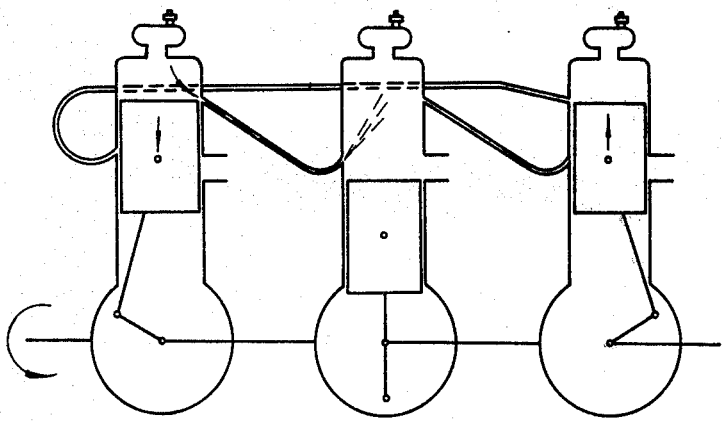

The principle of a three-cylinder internal combustion engine operation according to the present invention is as follows:

FIG. 1 shows diagrammatically an engine at the moment the piston uncovered the inlet port 8 of the gas duct 5 in the cylinder 2 after the ignition. At this moment a certain amount of combustion gases passes at a high velocity and high pressure into the space of the cylinder 3 carrying along and atomizing on their way the fuel supplied to metering valve 15 by a variable-delivery pump 19. This fuel is injected into the precombustion chamber 20. FIG. 2 represents the same engine after the rotation of the crankshaft by 120 deg., the combustion gases being taken from the cylinder 3 and injected into the cylinder 1. In FIG. 3 fuel is injected into the cylinder 2 and combustion gases are taken from the cylinder 1.

The injection into individual cylinders takes place as soon as the piston comes near the bottom dead centre, which is advantageous owing to the long period of time during which mixture is generated in the cylinder, i.e. almost during the entire compression stroke. The injection moment is determined by the position of inlet or ejection ports (7,8,9) of ducts (4,5,6) in relation to the top dead centre of the piston, which ports must be present in the cylinder wall above the piston midstroke. On the other hand, because of a pressure difference required for effecting the injection, the injection ports (10,11,12) must be located in the cylinder wall below the piston midstroke.

Figure 4:
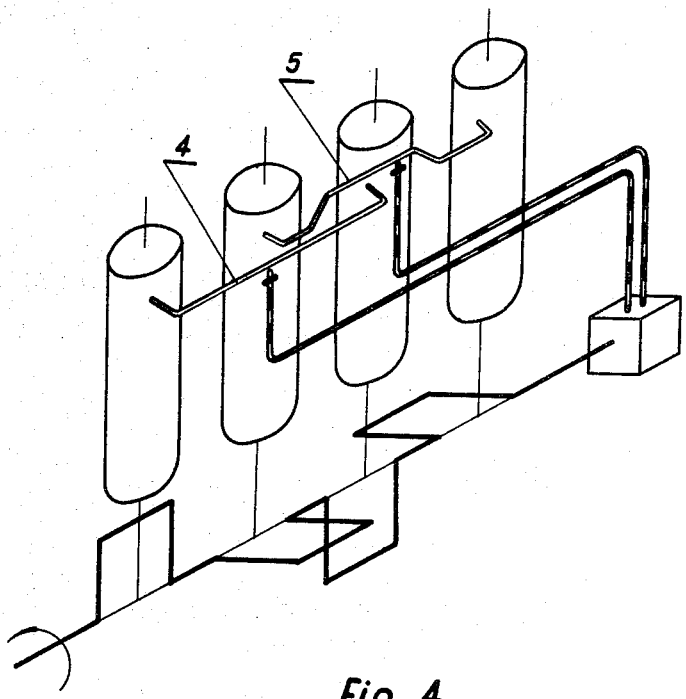
FIG. 4 shows diagrammatically a duct system in a four-cylinder engine.

The principle of operation of a two-stroke, four-cylinder, pump-less injection engine according to this invention is shown in FIG. 4 which is restricted to the representation of a diagram of interconnection between individual cylinders by gas ducts. Only such pairs of cylinders are interconnected for which the crankshaft crank arms are spaced 180 deg. apart on the drawing of cylinders 1 and 3, and 2 and 4. In this way two systems such as shows for a two-cylinder engine. FIG. 7, are obtained, the cylinders being connected two by two by means of a single duct 5 and 6, in FIG. 6, and the inlet and outlet ports of this duct being located in the cylinder wall above the piston midstroke at the same distance from the piston top dead centres.

Figure 5:
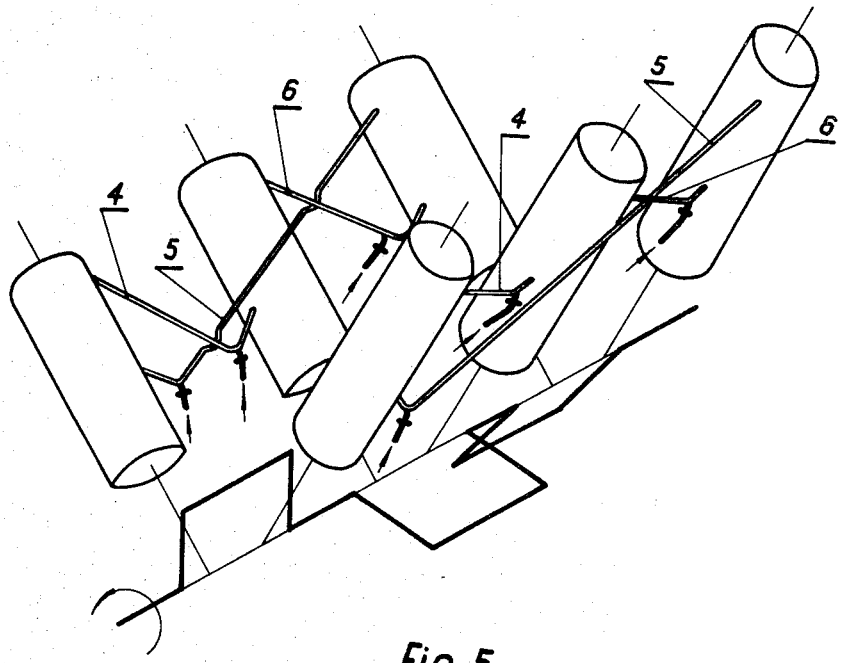
FIG. 5 and FIG. 6 in a six-cylinder engine.
Figure 6:
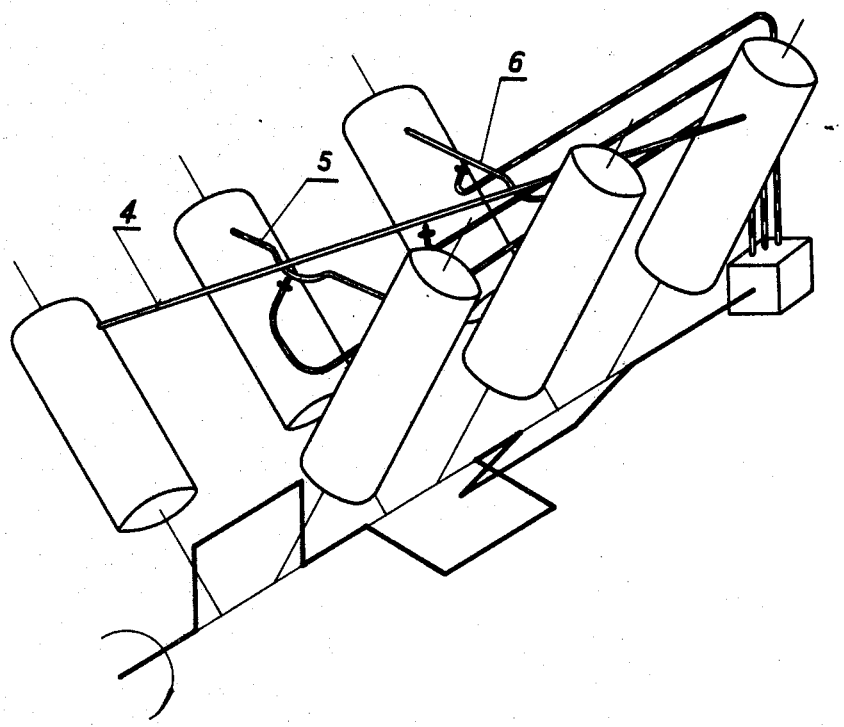
Figure 7:
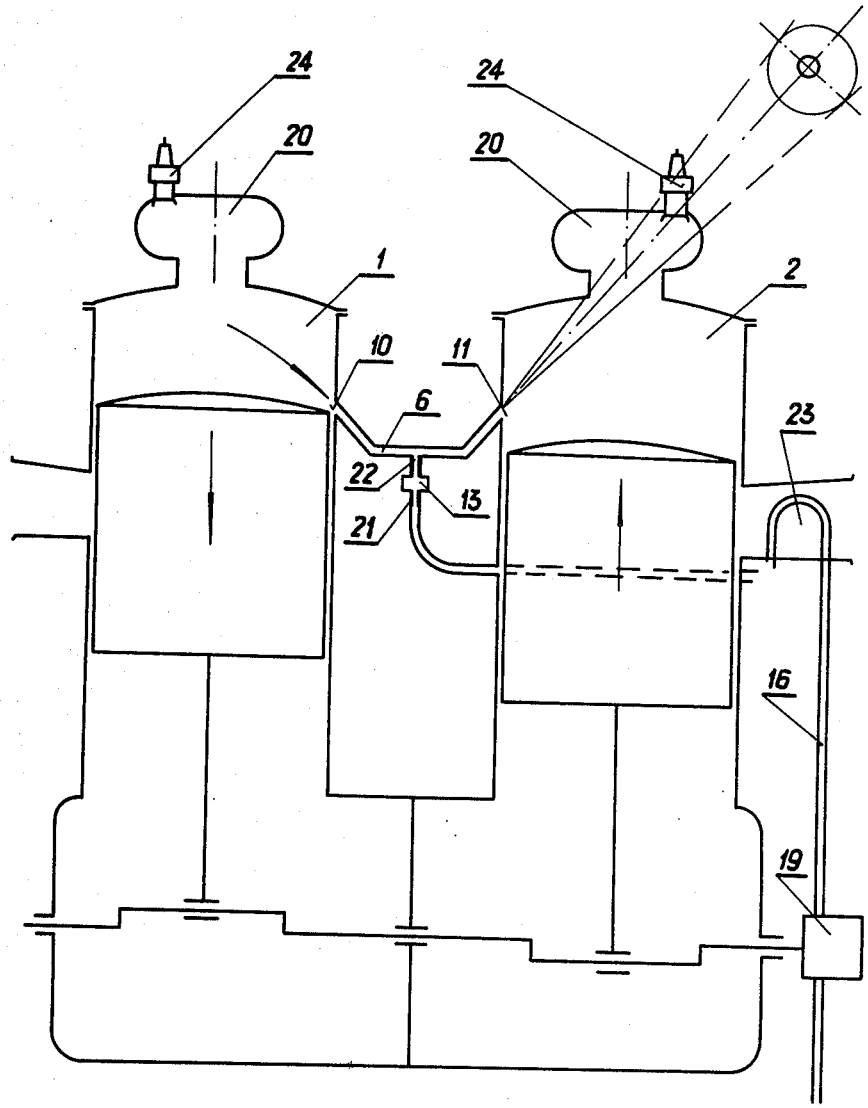
FIG. 7 shows diagrammatically a two cylinder two-stroke engine, the direction of injection into the precombustion chambers, location of spark plugs, fuel metering valve and fuel heater being indicated.

The principle of operation of a six-cylinder engine according to the present invention is shown diagrammatically in FIG. 6. This figure also is restricted to the representation of a diagram of connections between individual cylinders by means of gas ducts. The principle of interconnection is such that three pairs of cylinders are interconnected (FIG. 6) for which the crankshaft arms are spaced 180 deg. apart. In this case two cylinders are connected by a single gas duct 4,5, and 6, located as in a two-cylinder engine above the piston midstroke and at the same distance from piston top dead centres. The other principle of cylinders interconnection, FIG. 5, is such that each three cylinders are interconnected for which the crankshaft crank arms are spaced 120 deg. apart, as was done in the case of three-cylinder engine (FIG. 1, 2 and 3), each of said three cylinders being connected with two remaining ones by means of two gas ducts 4,5 and 6.

FIG. 7 shows the supply system according to the present invention on an example of a two-stroke, two-cylinder engine in which the crankshaft cranks are spaced 180 deg. apart. The fuel is supplied at a controlled rate by the pump 19 to the duct 16. A certain length of the duct 16 passes through the engine exhaust manifold, thereby forming a fuel preheater. The temperature to which the fuel is preheated is almost independent of the engine load, since the change in the combustion gases temperature is approximately inversely proportional to the number of engine revolutions, i.e. to the heating time of a given fuel charge. The preheated fuel is delivered to the fuel metering valve 13. The fuel metering valve 13 is of an open type and has no automatic check valves. It consists of an inlet passage 21, and outlet passage 22 and a metering chamber. The bores of the passages 21 and 22 are smaller than half of the bore of gas duct 6 joining the cylinder together. The cubic capacity of the meter chamber is somewhat greater that the maximum fuel charge per operating cycle of one cylinder.

As soon as the piston uncovers the inlet 10 of the gas duct 6 in the cylinder 1 during the operation cycle, a flow of a certain small amount of combustion gases occurs in the duct 6, the fuel being carried along from the metering valve 13 and atomized, and a charge of fuel contained therein being injected into the cylinder 2. After the rotation of the crankshaft by 180 deg. the combustion gases flow through the duct 6 from the cylinder 2 into the cylinder 1 and the injection of fuel supplied meantime to the metering valve 13 takes place at the same time.

The bore of the gas duct 6 at the narrowest place is smaller than 0.04 of the cylinder bore. The ports of the gas duct through the medium of which the fuel is injected (ports 10 and 11 in a two-cylinder engine and ports 10, 11 and 12 in a three-cylinder engine), located in the cylinder wall are directed in such a way that the injection stream strikes the inlet of the precombustion chamber 20. The spark plug 24 is located in the precombustion chamber within the conical surface formed by the injection stream FIG. 7.

Instead of fuel metering valves 13, 14 and 15 in the engine according to the present invention, solenoid-operated valves can be used, the opening time of which being controlled electronically.

Figure 8:
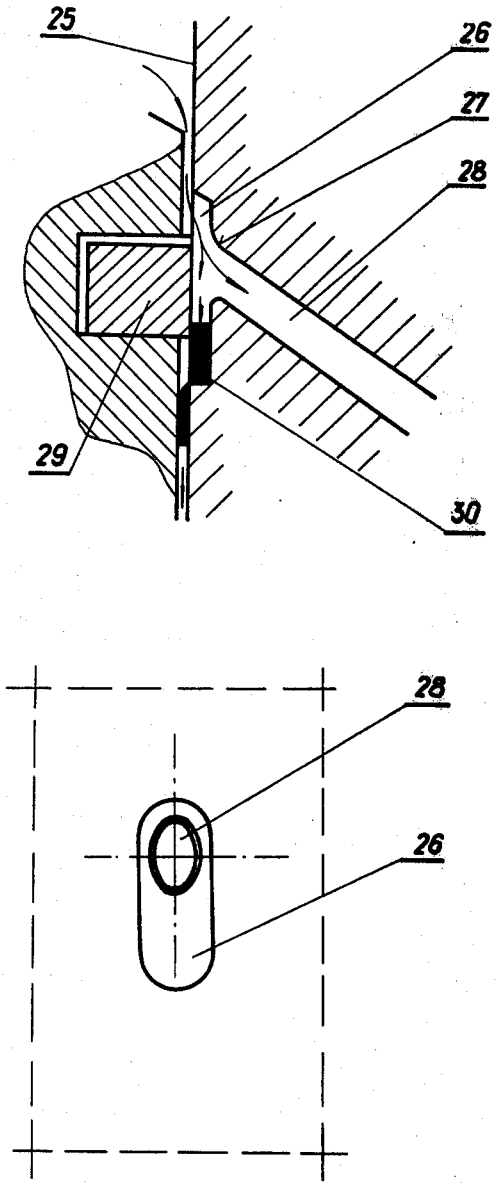
FIG. 8 represents the design of the gas duct inlet opening.

FIG. 8 shows the design of gas duct inlet port (ports 10 and 11 in the two-cylinder engine and ports 7, 8 and 9 in the three-cylinder engine). The injection port in the proximity of the cylinder bearing surface 25 is enlarged by a set-off forming the space 26, the edges 27 of the inlet port 28 being rounded off at the entrance to the gas duct.

The function of the space 26 is to collect the oil scraped by the piston or piston rings during the movement of the piston and during the working stroke; the instant the space 26 is uncovered by the upper piston ring 29, the oil 30 contained therein is blown between the piston and cylinder bearing surface.

As a result, no carbon deposits from the carbonized oil are collected in the tip of the gas duct port. The rounded off edges of the port eliminate whirling of the gas stream.

What we claim is:

1. A two stroke pumpless fuel injection internal combustion engine comprising:

a first and second cylinder each having a piston therein and each defining a working space in which said pistons move up and down, a precombustion chamber connected to the working space of said first cylinder, a connecting duct connecting the respective working space of said first and second cylinders, an injection port in said first cylinder at one end of said connecting duct and an ejection port in said second cylinder at the other end of said connecting duct, said connecting duct being positioned in such a way that its axis of symmetry is directed towards said precombustion chamber, a spark plug whose sparking end is in said precombustion chamber and is within the area defined by the injection stream of the fuel being directed into said precombustion chamber, and fuel supply means for supplying fuel to said connecting duct inbetween said injection and ejection ports, said fuel supply means comprising a valveless metering chamber with a capacity greater than the maximum charge of fuel needed for one working cycle, said metering chamber being connected to said connecting duct and to a fuel feeding duct for preventing uncontrolled receiving of fuel from the fuel feeding duct.

2. An internal combustion engine as claimed in claim 1 wherein said connecting duct substantially the same bore throughout its length and said fuel supply means cmprises inlet and outlet ducts leading to and from said metering chamber and each of a diameter less than one half of the bore of said connecting duct, said outlet duct being connected to said connecting duct.

3. An internal combustion engine as claimed in claim 1 wherein said injection port of said first cylinder and said ejection port of said second cylinder are both located in the cylinder wall above the piston midstroke and at the same distance from the piston top dead centers.

4. A two stroke pumpless fuel injection internal combustion engine comprising:

a first and second cylinder each having a piston therein and each defining a working space in which said pistons move up and down, a precombustion chamber connected to the working space of said first cylinder, a connecting duct connecting the respective working spaces of said first and second cylinders, an injection port in said first cylinder at one end of said connecting duct and an ejection port in said second cylinder at the other end of said connecting duct, said connecting duct being positioned in such a way that its axis of symmetry is directed towards said precombustion chamber, a spark plug whose sparking end is in said precombustion chamber and is within the area defined by the injection stream of the fuel being directed into said precombustion chamber, and fuel supply means for supplying fuel to said connecting duct inbetween said injection and ejection ports, said injection port widening in the proximity of the inside surface of said first cylinder, said widened portion of said injection port forming a set off which can collect oil which has been scraped from the cylinder wall by the piston, the edges of said inlet port being rounded off at the entrance to the connecting duct.

* * * * *